United States Patent [19]

Fujita et al.

[11] 4,367,091

[45] Jan. 4, 1983

[54] FIRED IRON-ORE PELLETS HAVING AT LEAST TWO DIFFERENT PRECIPITATED SLAG PHASES AND PROCESS FOR PRODUCING THE SAME

[75] Inventors: Isao Fujita, Kobe; Mamoru Onoda, Midorigaokahigashi; Takeshi Sugiyama; Shoji Shirouchi, both of Kobe, all of Japan

[73] Assignee: Kobe Steel, Ltd., Kobe, Japan

[21] Appl. No.: 937,836

[22] Filed: Aug. 29, 1978

Related U.S. Application Data

[63] Continuation of Ser. No. 777,662, Mar. 15, 1977, abandoned.

[30] Foreign Application Priority Data

Mar. 15, 1976 [JP] Japan ..... 51-28296

[51] Int. Cl.[3] ..... C21B 5/00; C22B 1/16

[52] U.S. Cl. ..... 75/0.5 R; 75/3; 75/5; 75/41

[58] Field of Search ..... 75/3, 4, 5, 33, 34, 75/35, 36, 37, 40, 41, 42, 0.5 R, 256

[56] References Cited

U.S. PATENT DOCUMENTS

| | | | |
|---|---|---|---|
| 2,450,343 | 9/1948 | Howard | 75/33 |
| 3,365,339 | 1/1968 | Beggs et al. | 75/5 |
| 3,975,182 | 8/1976 | Goetzman | 75/3 |

OTHER PUBLICATIONS

Levin, E. et al., *Phase Diagrams for Ceramists*, QD501L4, (1954), pp. 228–229.

*Primary Examiner*—Michael L. Lewis

*Attorney, Agent, or Firm*—Oblon, Fisher, Spivak, McClelland & Maier

[57] ABSTRACT

Fired iron-ore pellets are prepared which have at least two precipitated slag phases of different chemical compositions which appear among the iron-oxide grains of the pellets. The pellets each contain not less than 4% by weight of $CaO+SiO_2$ so that the resulting pellets have the characteristic of forming large cracks which are formed in the course of reduction of the pellets. The cracks which form cause each pellet to split into several pieces. The fired iron-ore pellets exhibit excellent reducibility.

3 Claims, 7 Drawing Figures

MICROSCOPIC VIEW OF PELLET HAVING CRACKS (x400)

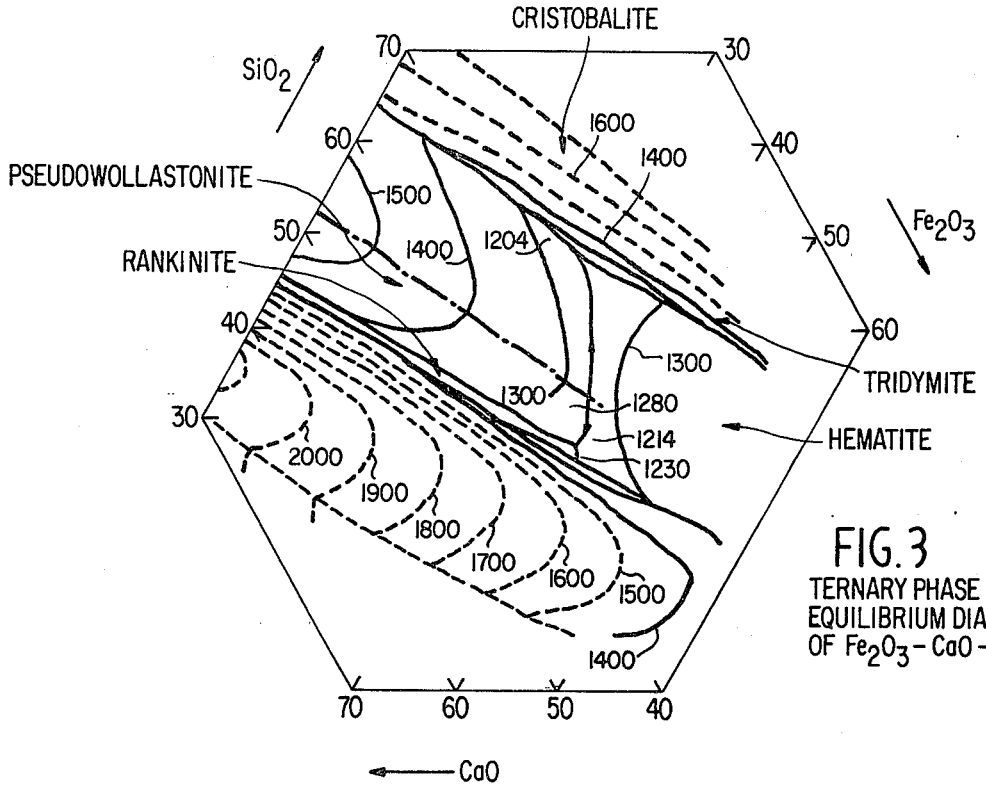
FIG. 3
TERNARY PHASE EQUILIBRIUM DIAGRAM OF $Fe_2O_3$ - CaO - $SiO_2$
FIG. 6
DIAGRAMMATIC VIEW OF PELLETS HAVING CRACKS
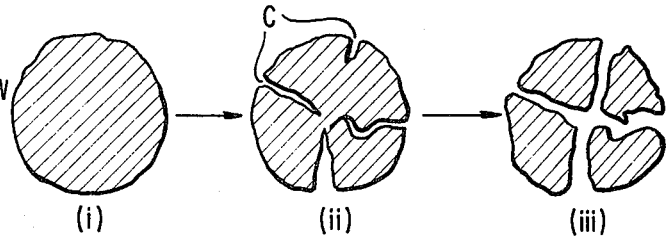
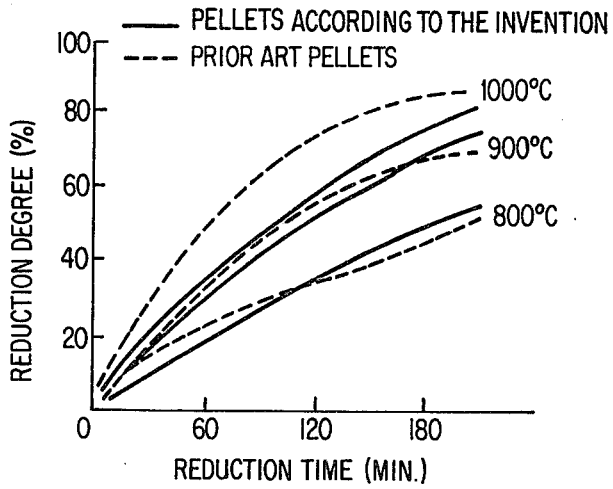
FIG. 7 REDUCTION CURVES OF PELLETS ACCORDING TO THE INVENTION (HAVING CRACKS) AND PRIOR ART PELLETS (ACID PELLETS)

FIG.4
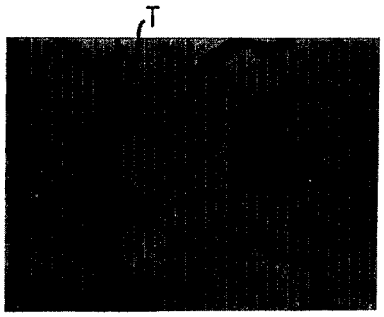
MICROSCOPIC VIEW OF PELLET HAVING CRACKS (x400)
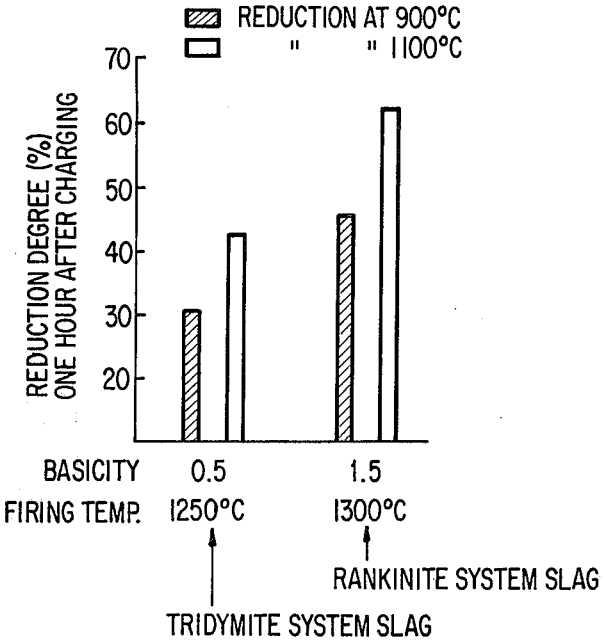
FIG.5 COMPARISON OF REDUCTION DEGREE OF PELLETS CONTAINING SLAGS

FIRED IRON-ORE PELLETS HAVING AT LEAST TWO DIFFERENT PRECIPITATED SLAG PHASES AND PROCESS FOR PRODUCING THE SAME

This is a continuation of application Ser. No. 777,662, filed Mar. 15, 1977, now abandoned.

BACKGROUND OF THE INVENTION

1. Field of the Invention

The present invention relates to fired iron ore pellets having precipitated slag phases of at least two different chemical compositions, and which provided excellent reducibility for use in the manufacture of pig iron in a blast furnace and to a process for producing the same.

2. Description of the Prior Art

Recently, a trend has developed for increasing the yield of fired iron ore pellets by utilizing low grade and fine iron ore produced during mining and screening processes. (Fired iron ore pellets will simply be referred to as pellets or iron-ore pellets, hereinafter.)

In addition, iron ore can be easily pelletized into pellets of the desired sizes which afford uniform properties. The iron ore pellets have the feature that their properties can be varied by simply changing the conditions of production of the pellets. For these reasons, iron ore pellets find wide use in blast furnaces.

Because of the manner in which pelletizers operate, iron ore pellets in the past have been produced in spherical form or the equivalent, so that the ratio of the outer surface area of the pellet to its volume is minimized. This is apparently undesirable from the viewpoint of the reducibility of the pellets, because the larger the area of contact between the reducing gases and the materials to be reduced, the better the reducibility of the pellets. Thus, in order to improve the reducibility of the pellets, it has been proposed to increase the porosity of the pellets, particularly the open-porosity thereof.

In general, iron ore pellets have mirco-pores which provide a relatively high degree of porosity to the pellets of about 30%. Consequently, the pellets exhibit good reducing properties in reduction processes at temperatures less than 900° C. Furthermore, depending upon the conditions of production of the pellets, pellets sometimes result which suffer from low porosity and, hence, possess decreased reducibility, although the pellets possess the desired compressive strength, tumbler index, softening properties, swelling properties, and the like.

In addition, another problem arises in that at high-temperature reduction at temperatures of over 1000° C., the micro-pores of the pellets are closed or clogged by low-melting slag because of the sintering reaction of pellet forming grains, thus leading to retardation of reduction.

In order to avoid these shortcoming of the pellets, one solution has been to increase the outer surface areas of the pellets. However, attempts to reduce the grain size of the pellets has led to a lowering of the permeability of the charge in a blast furnace and sticking of the pellets into large-sized lumps which impairs the satisfactory operation of a blast furnace. For this reason, this approach to the problem has been considered to be unsatisfactory.

Another one of the shortcomings of the prior art pellets stems from the physical properties of the pellets, i.e. the spherical shape thereof, in that the spherical shape of the pellets exerts a considerably adverse effect on the operation of the blast furnace. The shortcomings of the conventional pellets will be described in more detail by reference to FIGS. 1 and 2 hereinafter.

In the operation of a blast furnace, as shown in FIG. 1, spherical pellets of sizes ranging from 5 to 20 mm in diameter and in a preweighed amount are alternately charged with batches of coke which serve as a reducing agent through charging portion 2 of blast furnace 1 with the result that pellet layers (PL) and coke layers (CL) are formed within the furnace in a layer-by-layer relationship, i.e. with one layer on top of another. As a result of this method of charging the furnace, the surface contour of the top layer, in general, assumes a "V" shape in its cross section, i.e. the center portion of the top layer is the lowest part of the uppermost layer and then the layer slopes upwards towards the peripheral portion of the layer. It is desirable to provide uniform piles of pellet layers (PL) and coke layers (CL) in the furnace which have a minimized variation in thickness in the radial direction of the furnace. However, in practice, this results in a failure to achieve a successful operation, because of the marked difference in physical properties between coke and pellets. As shown in FIG. 2, when pellets (P) are charged to a furnace onto the top layer of coke (CL) within a furnace, the pellets tend to flow from the outer periphery of the furnace towards its center so that the thickness (t1) of the central portion of the pellet layer (PL) is thicker in comparison to the thickness (t2) of the peripheral portion of the pellet layer, thus providing a lack of uniformity in the thickness of the pellet layer in the radial direction of the furnace. When coke is further charged onto the top pellet layer (PL), the amount of coke which tends to flow from the peripheral portion of the furnace towards its center is reduced, relative to the flow pattern of pellets because the coke particles are of a larger size than the pellets. As a result, the thickness (t1) of the central portion of the coke layer (CL) is substantially decreased in comparison to the thickness (t2) of the peripheral portion of the coke layer (CL), thereby providing a lack of uniformity in thickness of coke layer in the radial direction of the furnace. In this manner, the pellet layers and the coke layers are laid one on top of another within the furnace, resulting in a distribution in which the pellets tend to segregate in the central portion of the furnace while the coke tends to segregate toward the peripheral portion of the furnace, as shown in FIG. 2. As a result, the speed of gases flowing from the base of the furnace upward through the peripheral portion of the charge in the furnace is faster than the speed of gases flowing upward through the central portion of the charge in the furnace, as shown by the arrows in FIG. 2. It follows from this that the temperature in the peripheral portion of the charge in the furnace is higher than the temperature in the central portion of the charge, so that the amount of reducing gases which is produced is increased in the peripheral portions of the charge relative to the amount of gases produced in the center of the charge. Thus, reduction of the pellets occurs unevenly across the bed in the furnace with a greater extent of reduction occurring in the periphery of the portion thereof.

The amount of a charge which flows into the central portion of the furnace is largely dependent upon the so-called "angle of repose" of the charge therein. Table 1 shows the relationship between the angles of repose and inclined angles of layers in a furnace. The angle of repose of pellets is smaller than that of coke, and such a difference in angle of repose is responsible for the lack of uniformity in thickness of the layers in a furnace. On the other hand, the angle of repose of sintered ore is on the same order of that of coke, so that the flow pattern of conventional ore pellets does not occur with sintered ore and a uniform distribution of thickness of deposited layers may be readily achieved. This may be attributed to the fact that pellets are of a spherical form approximating a true sphere and, therefore, the pellets provide smooth contacting surfaces which give rise to extremely low contact frictional resistance between pellets in comparison to sintered ore or coke of a complex, irregular shape.

TABLE 1

| Charge | Angle of repose | inclined angle of layer |
|---|---|---|
| Pellets | 25 to 28° | 20 to 26° |
| sintered ore | 31 to 34° | 29 to 31° |
| coke | 30 to 35° | 33 to 38° |

As has been described, the lack of uniformity in flow of the prior art pellets towards the center of a furnace and the distribution pattern of thickness thereof leads to a disturbance in the uniformity of the coke layers and a biased flow of reducing gases towards the peripheral portion of the charge in an inconsistent manner, as well as to unbalanced descent of charge into the furnace. This impairs the reducing reaction within the furnace and lowers the operational efficiency thereof. In addition, even after the pellets are charged in the furnace, vibrations or irregular movements of the pellets occur because of the flow of gas, so that the pellets tend to be mixed with an adjoining coke layer, thus causing an uneven thickness in the coke layers, which exerts an adverse influence on the permeability of the gases in the furnace and on the reactivity of the coke. The results are an increased coke ratio and lowered yield of production.

It is also known that the reduction of a pellet proceeds from its peripheral portions towards its central portion in a topochemical fashion. Thus, in the reduction reaction, a closely packed metallic iron layer, i.e. the products of reduction, is formed in the peripheral portions of the pellet at a high-temperature zone of a furnace, so that the ingress of reducing gases into the interior of the pellet is hindered, and hence, an unreacted core is likely to remain in the interior of the pellet. This drawback as well is attributable to the spherical shape of the ore pellet. Simultaneously, with the formation of an unreacted core in the pellet, the pellets soften and a lowering of the melting down temperatures of the pellets occurs with the result that the pellets become sticky. In addition, because of the spherical shape of the pellets, very closely packed layers of pellets occur within the furnace with the accompanying reduction in voids in the pellet layers. As a result, the sticking phenomenon of pellets is further promoted. Apparently, the sticky condition of the pellets detrimentally affects the permeability of the reducing gases in the pellets and consequently reduces the operational efficiency of the furnace.

A need, therefore, continues to exist for a method by which iron ore pellets can be more evenly and thoroughly reduced in a blast furnace.

SUMMARY OF THE INVENTION

Accordingly, an object of the present invention is to provide a solution to the shortcomings of prior art fired iron ore pellets in order to achieve improved operational efficiency of the furnace.

Another object of the present invention is to provide fired iron-ore pellets and a process for producing the same in which the pellets provide a large angle of repose which leads to stabilized layers of pellets in the blast furnace. The present invention is based on the discovery that pellets may be cracked in such a fashion that the reducibility of the pellets is greatly improved upon high temperature reduction. This is accomplished by a modification of the structure of the pellets when they are formed so that highly efficient and stable operation of the blast furnace may be achieved.

In the first aspect of the present invention for attaining the above, objects, at least two slag phases having different chemical compositions are formed among iron-oxide grains which form the individual pellets while the pellets contain not less than 4% by weight of $CaO+SiO_2$, whereby large cracks occur in the pellets in the course of reduction so that the pellets split into several pieces.

In the second aspect of the present invention, as limited by the first aspect of the present invention, the two precipitated slag phases are of the Tridymite and Rankinite systems.

In the third aspect of the present invention, as limited by the first aspect, the preferred range of amounts of $CaO+SiO_2$ contained in the pellets is between 4 and 12%.

In the fourth aspect of the present invention, as limited by the first aspect of the invention, the diameters of fired iron ore pellets are not less than 16 mm.

In the fifth aspect of the present invention, as limited by the first aspect of the present invention, the basicity of fired iron ore pellets falls within a range of $CaO/SiO_2=0.5$ to 1.28.

In the sixth aspect of the present invention, as limited by the first aspect of the invention, the fired iron ore pellets are produced at firing temperatures of not less than 1280° C.

In the seventh aspect of the present invention, a process is provided for producing fired iron ore pellets, in which the raw materials for iron ore pellets are crushed, pelletized, fired and cooled. In the process, a slag of $CaO+SiO_2$ is added in an amount such that the pellets contain not less than 4% by weight to the raw materials for the formation of the iron ore pellets, after crushing thereof. Moreover, in the process, at least two slag phases of different chemical compositions are precipitated among the iron-oxide grains in the course of a cooling step, whereby the fired iron-ore pellets thus produced crack during the course of reduction and split into a number of pieces.

In the eighth aspect of the present invention, as limited by the seventh aspect of the present invention, two precipitated slag phases in the pellets are of Tridymite and Rankinite systems.

In the ninth aspect of the present invention, as limited by the seventh aspect of the present invention, the preferred range of amounts of $CaO+SiO_2$ in the pellets is between 4 and 12% by weight.

In the tenth aspect of the present invention, as limited by the seventh aspect of the present invention, the diameters of the fired iron ore pellets are not less than 16 mm.

In the eleventh aspect of the present invention, as limited by the seventh aspect of the invention, the basicity of the fired iron ore pellets as determined by the ratio of $CaO/SiO_2$ is adjusted to the range of 0.5 to 1.28.

In the twelfth aspect of the present invention, as limited by the seventh aspect of the invention, the firing temperatures of the iron ore pellets are not less than 1280° C.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 3 is an enlarged view of an essential part of the ternary phase equilibrium diagram of $CaO$-$SiO_2$-$Fe_2O_3$;

FIG. 4 is a diagrammatic microscopic view of a pellet according to the present invention;

FIG. 5 is a graphical presentation of the degree of reduction of pellets consisting essentially of slags of the Rankinite and Tridymite systems one hour after the charging;

FIG. 6 is a series of diagrammatic views showing the progressive development of cracks in pellets during the course of reduction in the process of the present invention; and FIG. 7 is a graph showing the degree of reduction of pellets according to the present invention.

DESCRIPTION OF THE PREFERRED EMBODIMENTS

Figure 1:
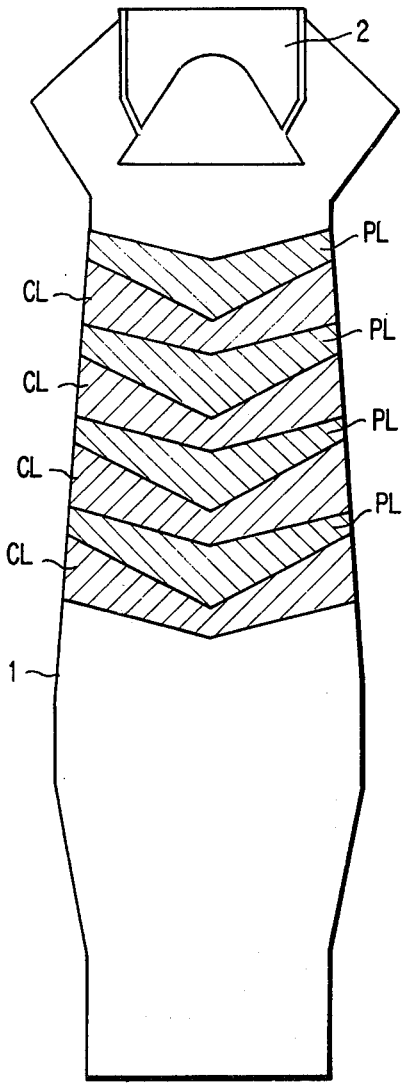
FIG. 1 is a longitudinal cross-sectional view of a blast furnace showing the distribution of pellets and coke charged therein.
Figure 2:
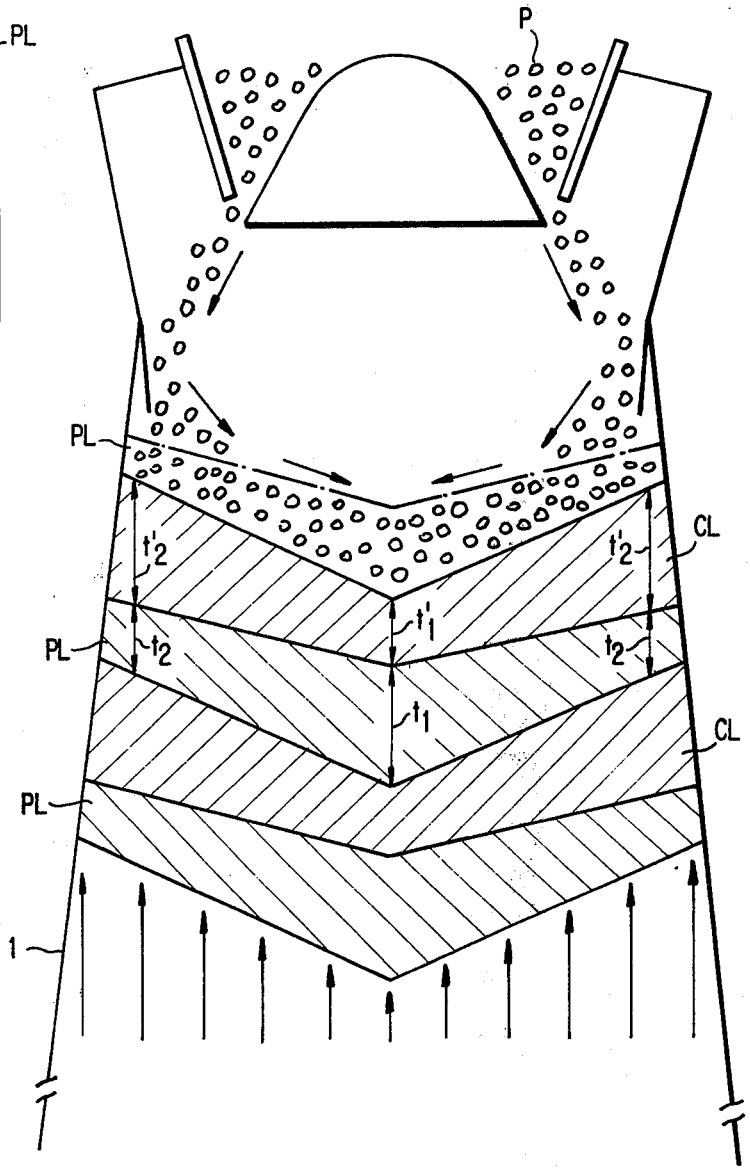
FIG. 2 is a longitudinal cross-sectional view of a charging portion of a blast furnace which illustrates the fluidic characteristics of pellets at the time of charging.

The present invention provides fired iron ore pellets of excellent reducibility, and a process for producing the same, in which large cracks are produced in pellets in the course of reduction, so that each of the pellets is split into several pieces.

As has been described earlier, the present invention is directed to avoiding the shortcomings confronted by the prior art process for producing and utilizing fired iron ore pellets, by modifying the physical characteristics of the pellets of a relatively large size. In comparison to the prior art pellets, the properties of the present pellets are different to such an extent that the present pellets exhibit excellent reducibility at high temperatures, without increasing the porosity of pellets and reducing the sizes thereof.

In other words, the present invention, provides fired iron ore pellets and a process for producing the same, in which at least two slag phases of different chemical compositions are formed among the iron oxide grains of each pellet, while the pellets each contain not less than 4% by weight of $CaO+SiO_2$.

An important feature of the pellets thus produced is that cracks are formed in the radial direction of the pellets during the course of reduction, so that pellets are each split into several pieces because of the cracks produced.

The characteristics of the present pellets will be described in more detail with reference to the accompanying drawings.

FIG. 3 shows an enlarged view of an essential part of the phase equilibrium diagram of $CaO$-$SiO_2$-$Fe_2O_3$. When pellets containing a mineral gangue having a basicity of 0.5 to 1.28, particularly about 1 (one point chain line) are fired at a high temperature of not less than 1280° C., the mineral gangue is changed into a molten slag of the pseudowollastonite system, with the molten iron therein being driven out. As the pellets are being cooled, the molten slag is precipitated in the form of the slag phases of the Tridymite and Rankinite systems, starting from the intersecting of the one point chain line with the isothermal line at 1280° C. FIG. 4 shows a microscopic view (X 400) of a pellet after cooling. Reference character H in the drawing represents Hematite grains (iron oxide), R represents a slag of the Rankinite system, and T represents a slag of the Tridymite system. As can be observed from the photograph, the slag phase which precipitates consists of two different uneven phases. FIG. 5 shows a comparison in the degree of reduction of two types of pellets which essentially consist of both slags, in terms of the same raw material and same porosity. A marked difference in reduction degree was observed between both types of pellets and the difference is believed to be attributable to the different characteristics of the slags.

Since both types of slags are present in the present pellet in unequal amounts, a difference in reduction degree of the pellets occurs, thereby producing internal stresses in the slag phases which cause cracking of the pellets. FIG. 6 shows a diagrammatic view of the cracking which occurs in the pellets, in which a spherical pellet prior to reduction is shown at (i), a pellet in which several radial cracks (c) appear in the course of reduction is shown at (ii), and a pellet which has been split into several pieces by the progress of reduction is shown at (iii).

In order to produce pellets which crack in this manner, it is necessary to add slag in an amount sufficient to fill the space between iron oxide grains in the formation of the pellets. In other words, a slag of $CaO+SiO_2$ should be present in a pellet in an amount of not less than 4% by weight. If the amount of $CaO+SiO_2$ is less than 4% by weight, then no cracking occurs in the course of reduction of the pellets.

However, if an excessive amount of $CaO+SiO_2$ is present, then the strength of the pellets is decreased, and the pellets tend to pulverize upon reduction, thereby lowering the efficiency of production. For this reason, $CaO+SiO_2$ should be present in an amount up to 12%, desirably in a range of 4 to 12%.

In addition, the diameters of the present pellets should not be less than 16 mm. This is because slag phases of at least the Tridymite system and the Rankinite system are necessarily present in pellets, so that large cracks are produced in pellets in the course of reduction in a blast furnace, and thus each of the pellets is split into several smaller pieces. In order to control the cracking process to provide fragments of an optimum size, it is essential that the diameters of the present pellets should not be less than 16 mm.

In addition to having precipitated slag phases of the Tridymite system and the Rankinite system, it is preferable that the basicity of the pellets, i.e. the $CaO/SiO_2$ ratio, should be adjusted to within the range of 0.5 to 1.28, as has been referred to earlier. Moreover, the firing temperature should be at least not less than 1280° C. The cooling rate after firing is an important factor, and thus slow cooling is essential in order to allow the two phases of the slag to precipitate.

Having generally described this invention, a further understanding can be obtained by reference to certain specific examples which are provided herein for purpose of illustration only and are not intended to be limiting unless otherwise specified.

Limestone and silica sand were added to powdered iron ore in an amount of $CaO+SiO_2=8\%$ by weight in order to achieve a basicity of 1.0. Then, the mixture thus prepared was pelletized into green pellets of a size of 18 mm in diameter. The green pellets were fired at a temperature of 1300° C.

Table 2 shows the chemical analysis of fired iron ore pellets.

TABLE 2

| Composition | Fe | FeO | $SiO_2$ | CaO | $Al_2O_3$ | Mgo |
|---|---|---|---|---|---|---|
| Weight (%) | 63.81 | 0.57 | 3.70 | 4.15 | 0.37 | 0.03 |

The physical properties of the pellets thus obtained are such that the compressive strength is 686 kg/pellet, the apparent density is 3.92, and the porosity is 19.8%. It was proved that the pellets afford an extremely high compressive strength and thus are durable in transportation and other types of handling. Thereafter, the pellets were subjected to an isothermic reduction at temperatures of 800°, 900°, 1000° C. by using reducing gas of $CO/N_2=30/70$, with the result that large cracks appeared in the central portions of the pellets as shown at (ii) of FIG. 6, while a portion of the pellets split into pieces as shown in (iii) of FIG. 6.

It should be noted from FIG. 7 that decreases in the rate of reduction do not occur until the termination of reduction is achieved as shown by the solid lines in FIG. 7. This proves that the pellets according to the invention afford excellent reducibility in the later stages of reduction, in comparison to the prior art pellets whose reduction characteristics are shown in FIG. 7.

Having now fully described this invention, it will be apparent to one of ordinary skill in the art that many changes and modifications can be made thereto without departing from the spirit or scope of the invention as set forth herein.

What is claimed as new and intended to be secured by Letters Patent is:

1. Fired iron ore pellets, comprising:

a slag containing Rankinite and Tridymite slag phases which precipitate among the iron oxide grains in said pellets, said pellets being of a diameter of not less than 16 mm and having the characteristics of developing large cracks when the pellets are heated during reduction of the pellets, said heating fragmenting the pellets to an extent sufficient to substantially improve the reducibility of the pellets, the raw materials of said pellets being blended in amounts such that the amount of $CaO+SiO_2$ in said fired pellets ranges from 4% to 12% by weight and the $CaO/SiO_2$ ratio ranges from 0.5 to 1.28, and said fired pellets cooled at a rate from a firing temperature of at least 1280° C. which ensures slag phase precipitation in an amount sufficient to achieve said crack development during reduction.

2. In a process for producing fired iron ore pellets in which the raw materials including iron ore are crushed, pelletized, fired and cooled, the improvement comprising:

mixing the raw materials of said pellets comprising CaO, $SiO_2$ and iron ore such that the amount of $CaO+SiO_2$ in the fired pellets ranges from 4% to 12% by weight and the $CaO/SiO_2$ ratio ranges from 0.5 to 1.28;

pelletizing said mixed raw materials;

firing said pellets to a temperature not less than 1280° C.; and cooling said fired pellets which have a diameter of not less than 16 mm at a rate sufficient to precipitate slag phases of Rankinite and Tridymite thereby forming said fired pellets which develop large cracks when the pellets are heated during reduction of the pellets.

3. Fired iron ore pellets having at least two different slag phases which precipitate among the iron oxide grains in said pellets prepared by a method, comprising:

mixing the raw materials of said pellets comprising CaO, $SiO_2$ and iron ore such that the amount of $CaO+SiO_2$ in the fired pellets ranges from 4% to 12% by weight and the $CaO/SiO_2$ ratio ranges from 0.5 to 1.28;

pelletizing said mixed raw materials;

firing said pellets to a temperature not less than 1280° C.; and cooling said fired pellets which have a diameter of not less than 16 mm at a rate sufficient to precipitate said slag phases of Rankinite and Tridymite thereby forming fired pellets which develop large cracks when the pellets are heated during reduction of the pellets.

* * * * *

UNITED STATES PATENT AND TRADEMARK OFFICE

CERTIFICATE OF CORRECTION

PATENT NO. : 4,367,091

DATED : January 4, 1983

INVENTOR(S) : FUJITA ET AL

It is certified that error appears in the above—identified patent and that said Letters Patent is hereby corrected as shown below:

Column 1, line 39, change "mirco-pores" to --micro-pores--.

Column 3, line 17, change "Pellets" to --pellets--.

Signed and Sealed this

*Third* Day of *May 1983*

[SEAL]

*Attest:*

GERALD J. MOSSINGHOFF

*Attesting Officer*

*Commissioner of Patents and Trademarks*